US008439695B2

(12) United States Patent
Komiyama

(10) Patent No.: US 8,439,695 B2
(45) Date of Patent: May 14, 2013

(54) LEVER TYPE ELECTRICAL CONNECTOR

(75) Inventor: Ryuichi Komiyama, Tokyo (JP)

(73) Assignee: Tyco Electronics Japan G.K., Kanagawa-Ken (JP)

( * ) Notice: Subject to any disclaimer, the term of this patent is extended or adjusted under 35 U.S.C. 154(b) by 0 days.

(21) Appl. No.: 13/072,385

(22) Filed: Mar. 25, 2011

(65) Prior Publication Data

US 2011/0237109 A1 Sep. 29, 2011

(30) Foreign Application Priority Data

Mar. 26, 2010 (JP) ..... 2010-71169

(51) Int. Cl.
*H01R 13/62* (2006.01)

(52) U.S. Cl.
USPC ..... 439/157

(58) Field of Classification Search ..... 439/157, 439/345, 347
See application file for complete search history.

(56) References Cited

U.S. PATENT DOCUMENTS

| | | | | |
|---|---|---|---|---|
| 6,142,800 | A * | 11/2000 | Iwahori | 439/157 |
| 6,168,445 | B1 * | 1/2001 | Seutschniker et al. | 439/157 |
| 6,213,795 | B1 * | 4/2001 | Drescher et al. | 439/157 |
| 6,305,957 | B1 * | 10/2001 | Fink et al. | 439/157 |
| 6,447,312 | B1 * | 9/2002 | Takata | 439/157 |
| 6,666,697 | B2 * | 12/2003 | Yamashita | 439/157 |
| 6,824,406 | B1 * | 11/2004 | Sharples et al. | 439/157 |
| 6,896,531 | B2 * | 5/2005 | Bakker et al. | 439/140 |
| 6,960,090 | B2 * | 11/2005 | Denter et al. | 439/157 |
| 6,997,725 | B2 * | 2/2006 | Stella et al. | 439/157 |
| 7,011,536 | B2 * | 3/2006 | Okamoto et al. | 439/157 |
| 7,121,866 | B2 * | 10/2006 | Testa et al. | 439/347 |
| 7,568,925 | B2 * | 8/2009 | Ciriello et al. | 439/157 |
| 7,637,764 | B2 * | 12/2009 | Yoneda et al. | 439/275 |
| 7,695,296 | B1 * | 4/2010 | Hitchcock et al. | 439/157 |
| 7,837,485 | B2 * | 11/2010 | Epe et al. | 439/157 |
| 7,922,504 | B2 | 4/2011 | Sakamaki et al. | |
| 7,946,874 | B2 * | 5/2011 | Sakamaki et al. | 439/275 |
| 2003/0082940 | A1 * | 5/2003 | Yamashita | 439/157 |
| 2004/0121640 | A1 * | 6/2004 | Okamoto et al. | 439/347 |
| 2007/0232100 | A1 * | 10/2007 | Tyler | 439/157 |
| 2008/0166903 | A1 * | 7/2008 | Pittenger et al. | 439/136 |
| 2009/0221167 | A1 * | 9/2009 | Pittenger et al. | 439/157 |
| 2009/0263998 | A1 * | 10/2009 | Epe et al. | 439/157 |
| 2010/0105254 | A1 * | 4/2010 | Park et al. | 439/752 |
| 2010/0178791 | A1 * | 7/2010 | Komiyama et al. | 439/347 |

FOREIGN PATENT DOCUMENTS

JP 2001357938 A 12/2001

OTHER PUBLICATIONS

European search report, Reference No. AV925EPMR45402, Application No. 11159274.7-1231, dated May 30, 2011; 7 pages.

* cited by examiner

*Primary Examiner* — Amy Cohen Johnson
*Assistant Examiner* — Vladimir Imas
(74) *Attorney, Agent, or Firm* — Barley Snyder

(57) ABSTRACT

A lever type connector is mated with a mating connector by operating a rotatable lever with a mating portion being received in a receiving space of the mating connector. The lever type connector includes a slider having a cam groove and is moved by rotation of the lever. The mating connector further includes a cam pin positioned on a mating housing and inserted into the cam groove. A rib that constitutes a cam pin displacement restricting body is placed between a front cover that constitutes a part of a housing of the lever type connector 1 and the mating housing in a region corresponding to the cam pin.

22 Claims, 9 Drawing Sheets

LEVER TYPE ELECTRICAL CONNECTOR

CROSS-REFERENCE TO RELATED APPLICATIONS

This application claims priority under 35 U.S.C. §119 to Japanese Patent Application No. JP 2010-071169, filed Mar. 26, 2010.

FIELD OF INVENTION

The present invention relates to a connector and in particular to a lever-type connector to unite and release from a mating connector by rotation of a lever.

BACKGROUND

In recent years, electric connectors having numerous terminals are being used in the field of automobiles and the like, and are continually become more and more advanced. With an electric connector having numerous terminals, a large force is necessary to mate together connectors and release the connection. Therefore, in the field of automobiles and the like, a lever-type connector to mate with and release from a mating connector utilizing effect of boosting by a lever is used.

By way of example, a lever is mounted to a plug housing of a lever type connector (for example, holding a female contact) so as to be rotated between a mating start position and a mating end position, and a cam pin is provided on a receptacle housing of a mating connector (for example, holding a male contact). The housings are shallowly mated with each other with the lever being held in the mating start position, and thus the cam pin is inserted into a cam groove provided in a slider that linearly reciprocates as the lever is turned. The lever is then turned to the mating end position. Thus, the housings are mated with each other by cam action caused by engagement between the cam groove and the cam pin, and contacts (or terminal fittings) of the connectors are connected to each other. The term "rotation" refers to both clockwise and counterclockwise turns performed by the lever, and the term "turn" refers to either of the clockwise and counterclockwise turns.

When the lever type connector is mated with the mating connector, prying (also referred to as inclined mating) may occur such that the lever type connector (female connector) is inserted into the mating connector (male connector) in an inclined manner. Then, the cam pin does not properly enter the cam groove but is brought into contact with (rides on) a part other than the cam groove in the slider in some cases. This causes difficulty in rotation of the lever, but if the lever is forced to be turned toward the mating end position, a strong force may be applied to the cam pin to damage the mating connector. A connector using a thin housing because of a size reduction demanded of a connector in recent years together with numerous terminals may be highly likely to be damaged.

As means for preventing improper connection due to prying, a protrusion for preventing improper connection has been provided integrally with a housing (for example, see Japanese Patent Laid-Open No. 2001-357938). However, merely providing the protrusion for preventing improper connection sometimes cannot prevent improper mating.

SUMMARY

The present invention has been made to address the above-described conventional drawbacks, and has an object of providing a lever type connector that prevents damage to a housing of a mating connector having a cam pin even if a lever is operated without recognizing that improper mating has been performed. A lever type connector according to the invention is mated with a mating connector by operating a rotatable lever with a mating portion being received in a receiving space of the mating connector.

The lever type connector includes a slider having a cam groove and is moved by rotation of the lever. The mating connector further includes a cam pin positioned on a mating housing and inserted into the cam groove. A rib that constitutes a cam pin displacement restricting body is placed between a front cover that constitutes a part of a housing of the lever type connector 1 and the mating housing in a region corresponding to the cam pin.

BRIEF DESCRIPTION OF THE DRAWINGS

The invention is described in more detail in the following with reference to the embodiments shown in the drawings. Similar or corresponding details in the Figures are provided with the same reference numerals. The invention will be described in detail with reference to the following figures of which.

DETAILED DESCRIPTION OF THE EMBODIMENT(S)

Figure 1:
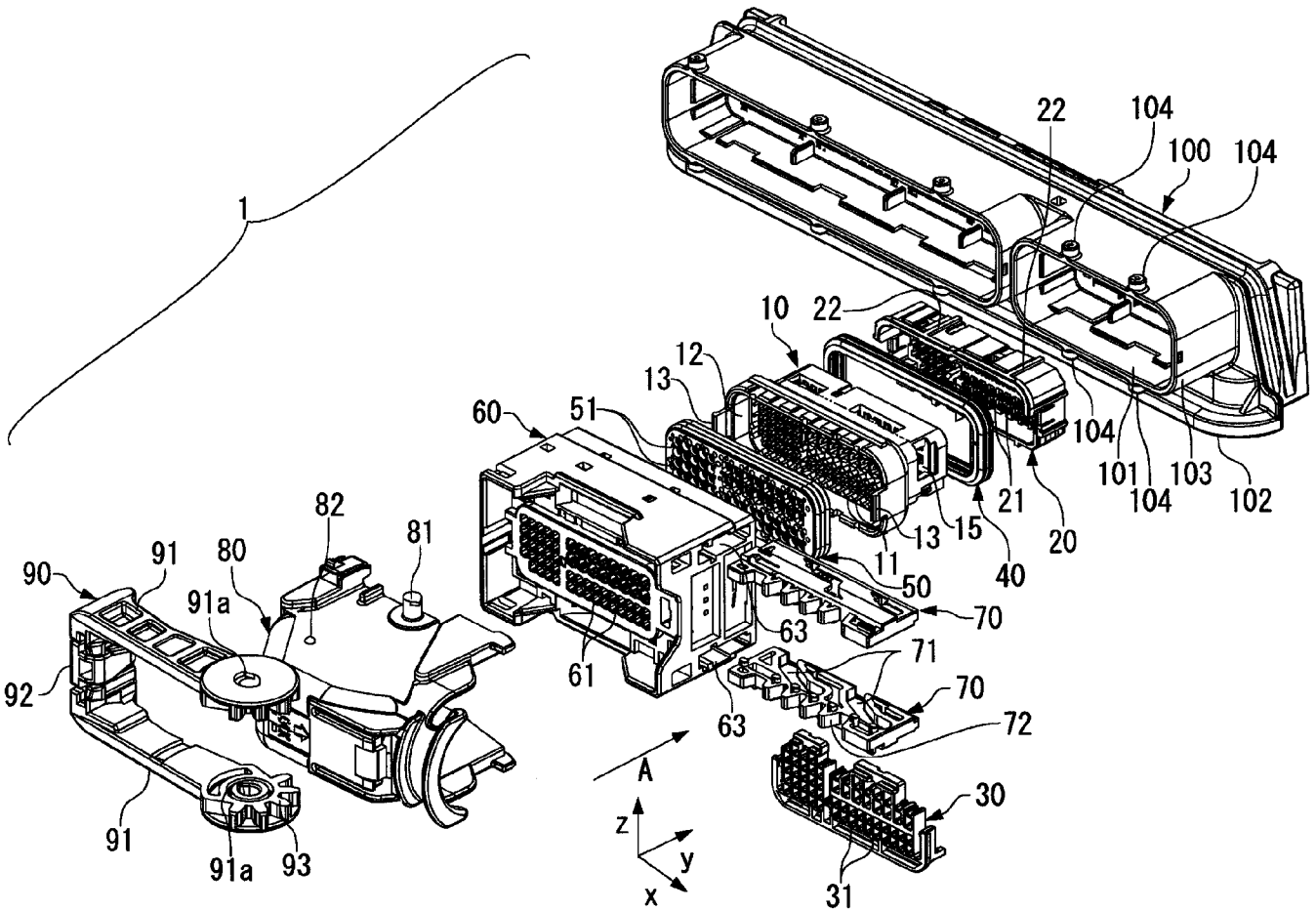
FIG. 1 is an exploded perspective view of a lever type connector according to the invention.

Now, the present invention will be described in detail based on an embodiment shown in the accompanying drawings.

A lever type connector 1 according to the invention includes an inner housing 10 that receives a plurality of female contacts (not shown), a front cover (lever side housing) 20, a retainer 30, a seal 40, a second seal 50, an outer housing 60, a pair of sliders 70, a wire cover 80, and a lever 90. The inner housing 10, the front cover 20, the retainer 30, the seal 40, the second seal 50, the outer housing 60, the pair of sliders 70, and the wire cover 80 are assembled to generally form a housing of the lever type connector 1. The lever type connector 1 is mated with a mating connector 100 using a lever mechanism.

In the inner housing 10 formed by injection molding of insulating resin, a plurality of contact receiving cavities 11 are provided to pass through in a front/back direction. In the embodiment shown, descriptions will be now made with definition that an x-axis direction in FIG. 1 is a width direction, a z-axis direction in FIG. 1 is a vertical direction, and a y-axis direction in FIG. 1 is a front/back direction (an inner side in a sheet surface of FIG. 1 is a front side, and an outer side in the sheet surface of FIG. 1 is a back side).

A contact is inserted into each contact receiving cavity 11 in a direction shown by an arrow A in FIG. 1. Each contact is primarily secured by a housing lance 14 (FIG. 3) provided in the inner housing 10. A second seal receiving space 12 that receives the second seal 50 is provided on the back side of the inner housing 10. A pair of latch arms 13 for locking the outer housing 60 to the inner housing 10 are provided at both ends in the width direction of the inner housing 10.

The front cover 20 formed by injection molding of insulting resin is configured to be mounted to a front side of the inner housing 10. As shown in FIG. 1, the front cover 20 extends in the width direction and covers a front surface of the inner housing 10, and has a plurality of mating contact insertion holes 21 into which mating contacts are inserted so as to pass through in the front/back direction.

The front cover 20 has a rib 22 in the front/back direction on an outer surface thereof, which acts as a cam pin displacement restricting body. The rib 22 formed to protrude beyond other parts of the outer surface of the front cover 20 is placed in a region corresponding to a cam pin 104 on the mating connector 100 between the front cover 20 and a mating housing 102. The rib 22 is placed in the corresponding region at least in an initial stage of mating of the lever type connector 1 with the mating connector 100. This will be described later in detail.

The retainer 30 formed by injection molding of insulting resin is configured to be placed in a retainer receiving recess 15 formed in the inner housing 10, and formed into a substantially plate shape extending in the width direction as shown in FIG. 1. The retainer 30 has a plurality of contact passageways 31 formed correspondingly to the contact receiving cavities 11 provided in the inner housing 10. The retainer 30 is temporarily held in the inner housing 10 in a temporary locking position where the contact can be inserted through the contact passageway 31 into the contact receiving cavity 11 (see FIGS. 3 and 4), and secured to the inner housing 10 in a full locking position where the contact is further pressed into the contact receiving cavity 11 (see FIGS. 8 and 9). When the retainer 30 is secured to the inner housing 10 in the full locking position, the contact is further secured by the retainer 30.

The seal 40 formed by injection molding of insulting rubber is formed into a ring shape as shown in FIG. 1 so as to be brought into tight contact with an outside surface of the inner housing 10. The seal 40 has a function of sealing between the mating housing 102 of the mating connector 100 and the inner housing 10, when the mating connector 100 is mated with the lever type connector 1 (see FIGS. 8 and 9), and preventing water from entering the inner housing 10 through a mating portion.

The second seal 50 is a rubber member formed into a substantially plate shape as shown in FIG. 1, and received in the second seal receiving space 12 formed on the back side of the inner housing 10. The second seal 50 is brought into tight contact with an inner peripheral surface of an outer wall portion that forms the second seal receiving space 12 of the inner housing 10. The second seal 50 has a plurality of passageways 51 having a circular section in positions corresponding to the contact receiving cavities 11 provided in the inner housing 10. Each passageway 51 passes through in the front/back direction. A wire (not shown) connected to the contact received in the contact receiving cavity 11 passes through the passageway 51 and is led out backward from the inner housing 10. A plurality of annular seal protrusions 52 are formed on the inner peripheral surface of each passageway 51 (FIG. 3), and each of the annular seal protrusions 52 is brought into tight contact with the outer peripheral surface of the wire and prevents water from entering the inner housing 10 through the passageway 51.

The outer housing 60 formed by injection molding of insulting resin is located so as to cover the inner housing 10, the front cover 20, the seal 40 and the second seal 50 with the lever type connector 1 being assembled, and locked to the inner housing 10 by the latch arm 13 provided in the inner housing 10. Thus, the second seal 50 is pressed in the front/back direction with respect to the inner housing 10. The outer housing 60 has a plurality of passageways 61 having a rectangular section formed in positions corresponding to the passageways 51 provided in the second seal 50. Each passageway 61 passes through in the front/back direction. The wire connected to each contact passes through the passageway 51 in the second seal 50 and the passageway 61 in the outer housing 60 and is led out backward.

A pair of slider receiving slots 63 extending in the width direction are formed in upper and lower ends of the outer housing 60. Also, a cam pin insertion hole 62 is positioned in an inside of the outer housing 60 into which the cam pin 104 is inserted. The cam pin 104 is positioned on the mating connector 100.

The slider 70 formed by injection molding of insulting resin is formed into a substantially plate shape as shown in FIG. 1, and slidably received in the slider receiving slots 63 in the outer housing 60. Two cam grooves 71 that pull and press the cam pins 104 on the mating connector 100 are positioned in an inner surface of each slider 70. A rack 72 that meshes with a pinion 93 in the lever 90 is formed at a back end edge of each slider 70.

The wire cover 80 formed by injection molding of insulting resin is mounted to a back side of the outer housing 60, and protects a bundle of wires led out backward from the contacts received in the contact receiving cavities 11 in the inner housing 10 through the passageways 61 in the outer housing 60.

A shaft 81 that fits in a shaft receiving passageway 91*a* in the lever 90 is positioned at a front end of each of upper and lower surfaces of the wire cover 80. A locking projection 82 that locks the lever 90 placed in the mating start position is provided on each of the upper and lower surfaces of the wire cover 80. Each locking projection 82 locks each side plate 91 of the lever 90 placed in the mating start position to prevent the lever 90 from turning toward the mating end position.

The lever 90 is rotatably supported with respect to the wire cover 80, and the pinion 93 that meshes with the rack 72 in the slider 70 is formed at a tip thereof. The lever 90 and the slider 70 act as a lever mechanism. When the lever 90 is rotated, the slider 70 is moved in the width direction, and thus the mating connector 100 is moved in a mating direction or a direction away from the lever type connector 1.

The lever 90 includes a pair of side plates 91 and a connecting portion 92 that connects one end of each of the side plates 91. The shaft receiving passageway 91*a* supported by the shaft 81 on the wire cover 80 is provided in the other end of each side plate 91. The lever 90 is mounted to the wire cover 80 so as to be rotatable between the mating start position and the mating end position with respect to the inner housing 10 around the shaft receiving passageways 91*a* in the side plates 91.

The mating connector 100 includes the mating housing 102 with a hood 103 including therein the cavity 101 that receives the front end of the lever type connector 1, and the cam pins 104 formed on side surfaces of the hood 103 in a vertical direction. Two cam pins 104 are formed on one side surface of the hood 103 correspondingly to the cam grooves 71 in the slider 70. The cam pin 104 passes through the cam pin insertion hole 62 in the outer housing 60 and is inserted into the cam groove 71 in the slider 70 when the lever type connector 1 is mated with the mating connector 100. A contact holding hole is omitted in FIGS. 3, 4, 7 and 8.

Next, an operation when the lever type connector 1 is mated with the mating connector 100 will be described.

In the lever type connector 1, the lever 90 is rotated with respect to the wire cover 80, and the pinion 93 in the lever 90 drives the rack 72 in the slider 70, and the slider 70 is moved along the width direction. When the lever 90 is turned toward the mating start position (one side in the width direction), the slider 70 is moved to the right in FIG. 1. When the lever 90 is turned toward the mating end position (the other side in the width direction), the slider 70 is moved to the left in FIG. 1.

Figure 2:
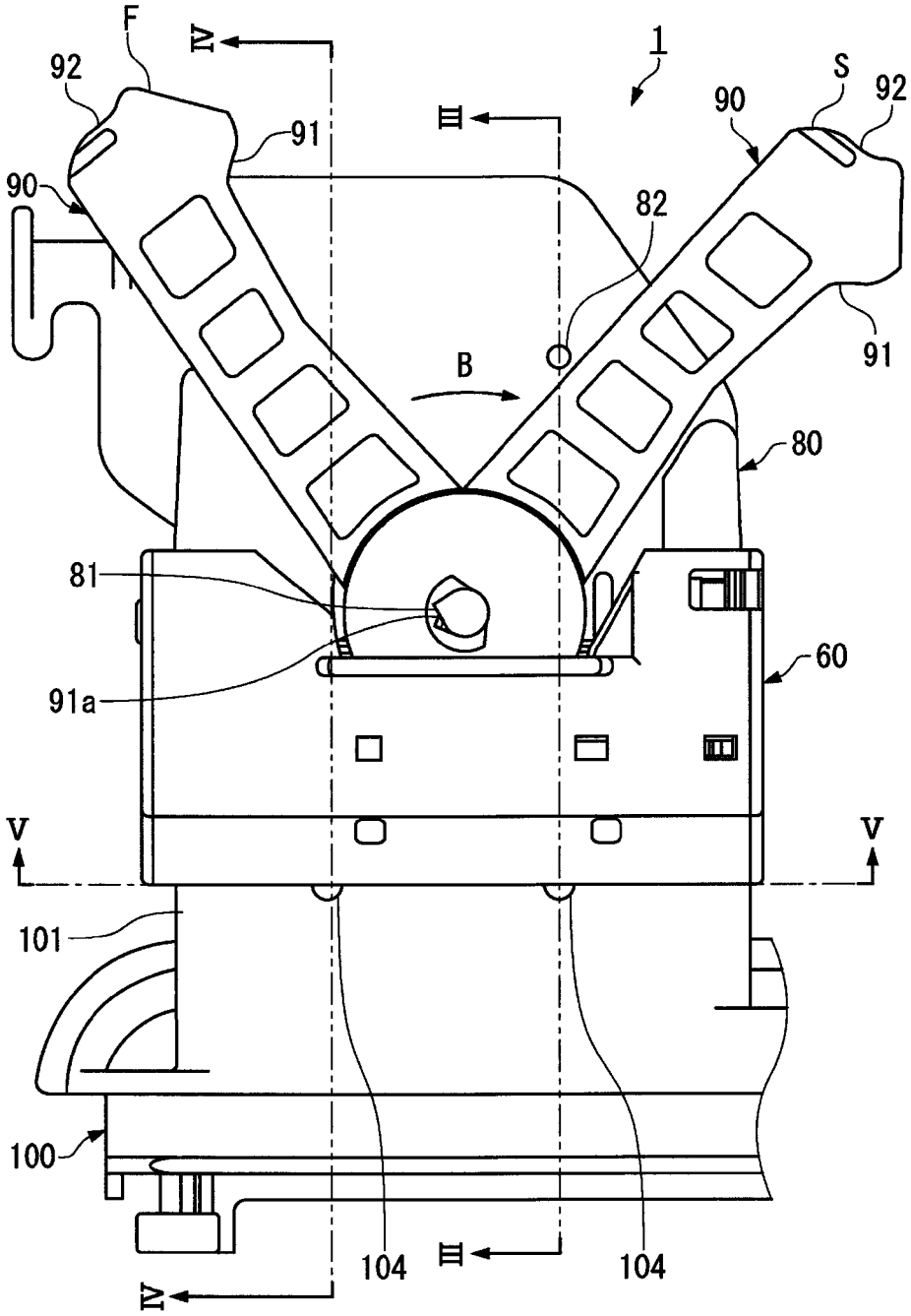
FIG. 2 is a plan view of the lever type connector in FIG. 1 initially mating with a mating connector.

In the lever type connector 1 having been assembled, the lever 90 is placed in the mating end position (F in FIG. 2). The mating connector 100 is shallowly mated with the lever type connector 1. Also in this state, the turn of the lever 90 can be restricted by a locking member (not shown).

Figure 3:
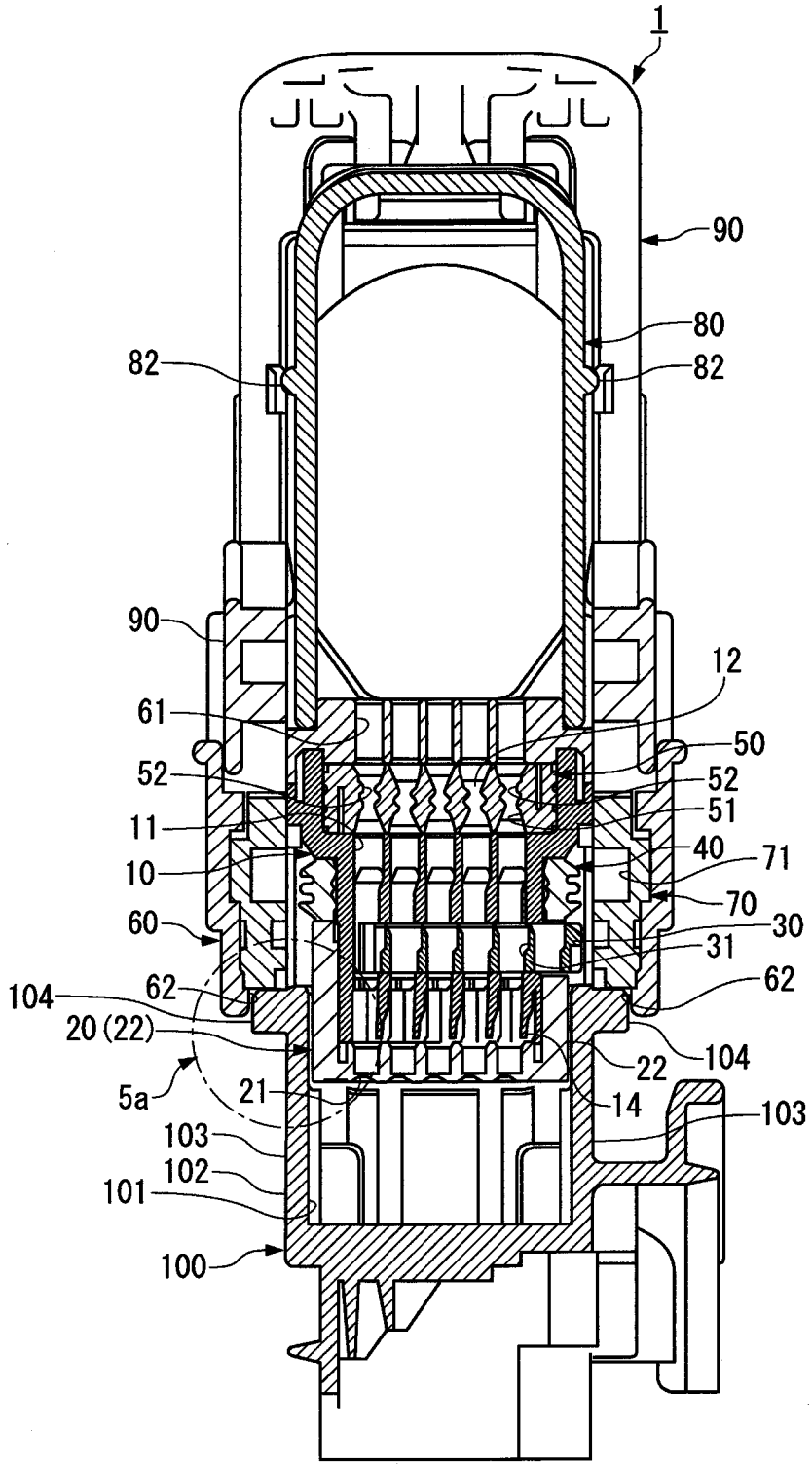
FIG. 3 is a sectional view taken along the arrowed line III-III in FIG. 2.
Figure 4:
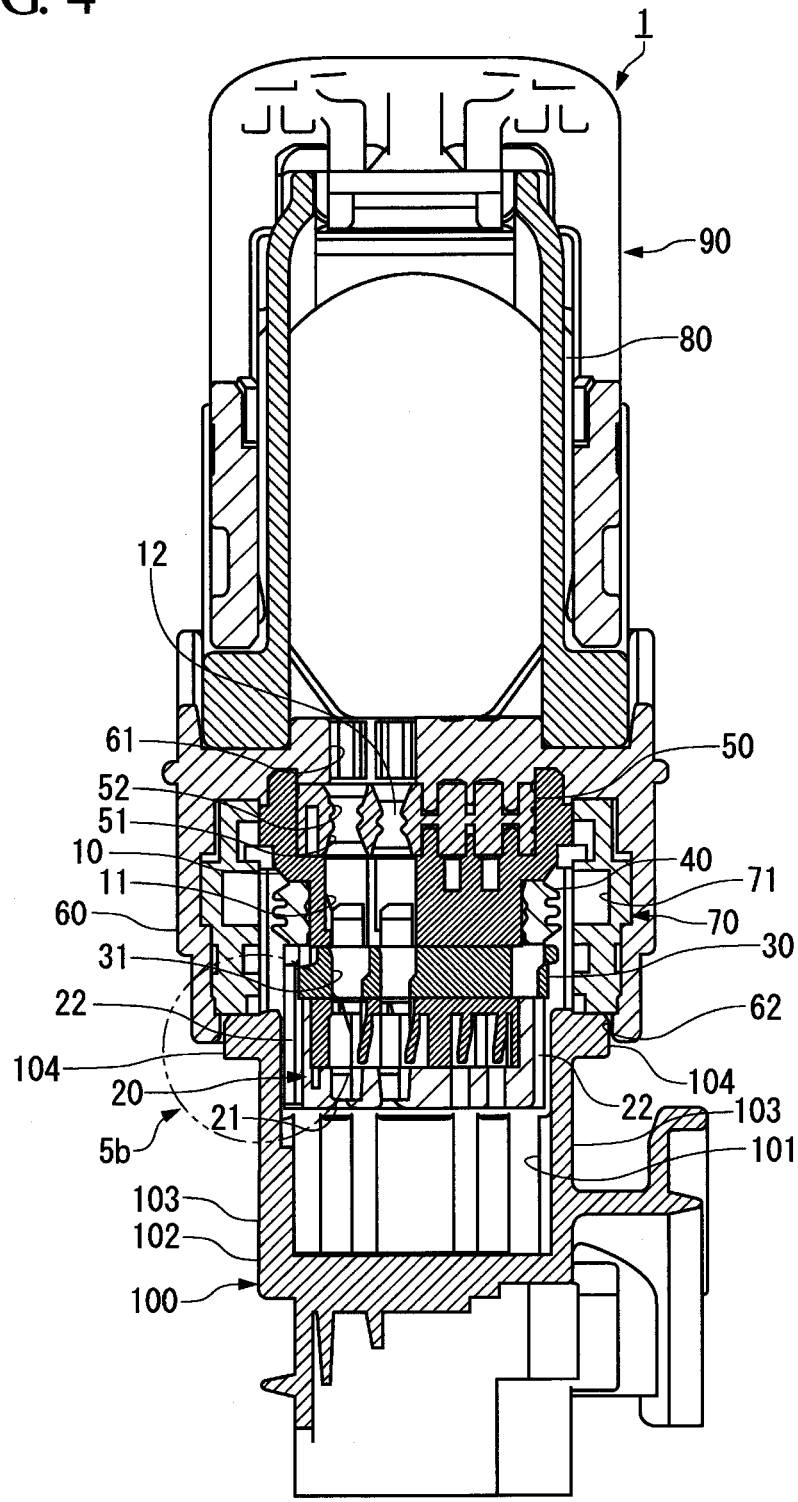
FIG. 4 is a sectional view taken along the arrowed line IV-IV in FIG. 2.
Figure 5:
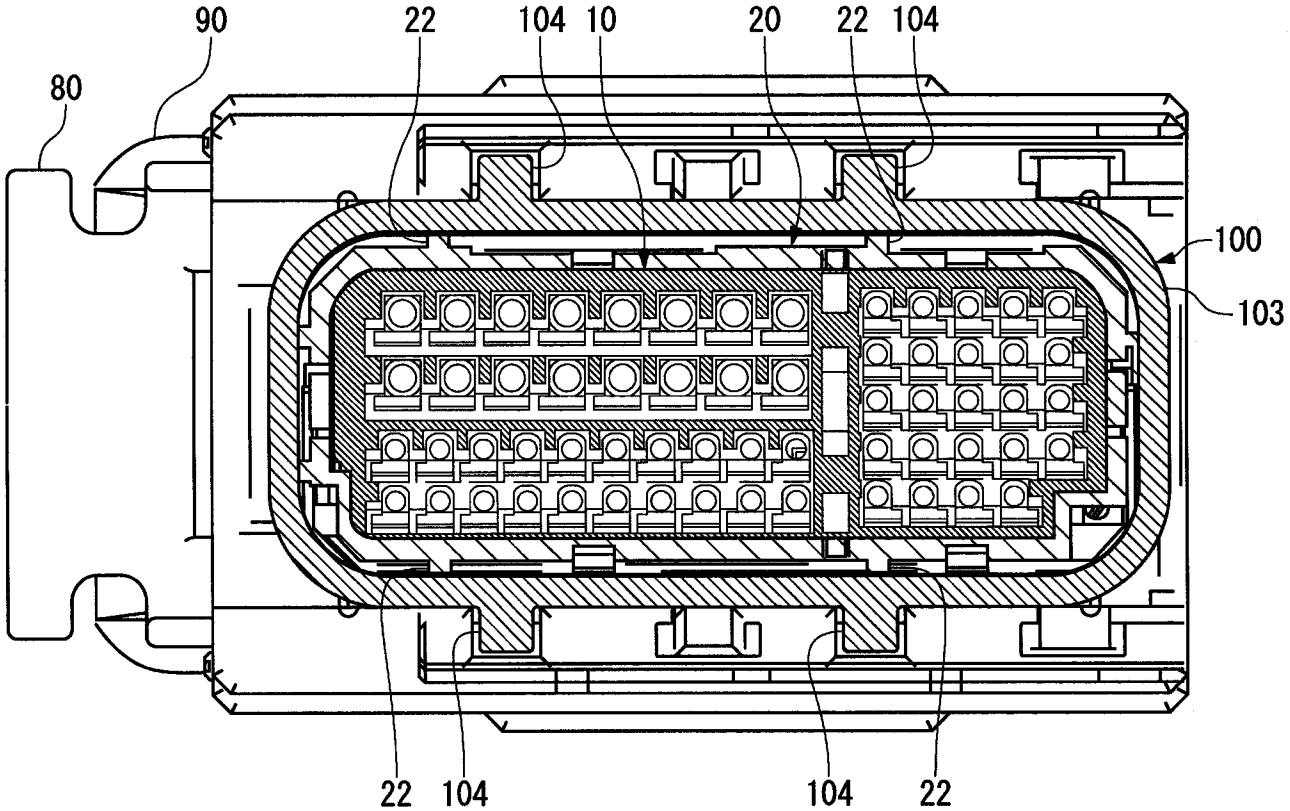
FIG. 5 is a sectional view taken along the arrowed line V-V in FIG. 2.
Figure 6A:
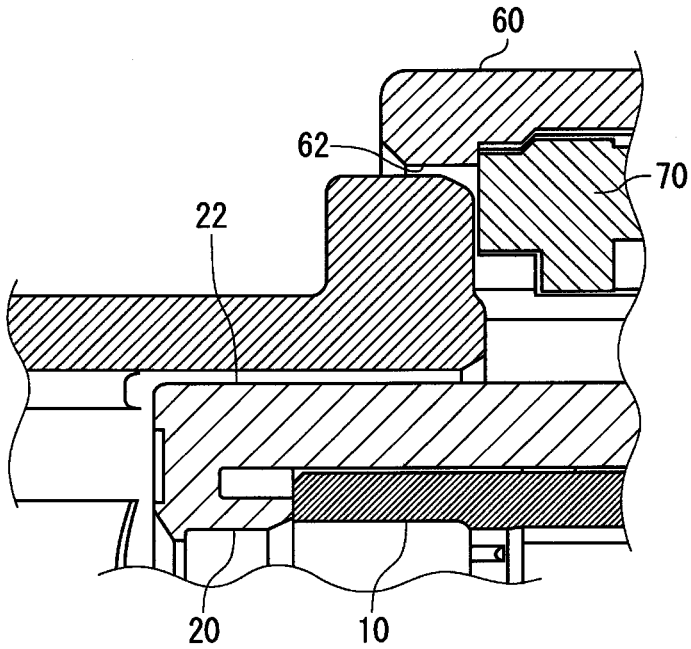
FIG. 6A is an enlarged view of a front cover of the lever type connector in FIG. 3.
Figure 6B:
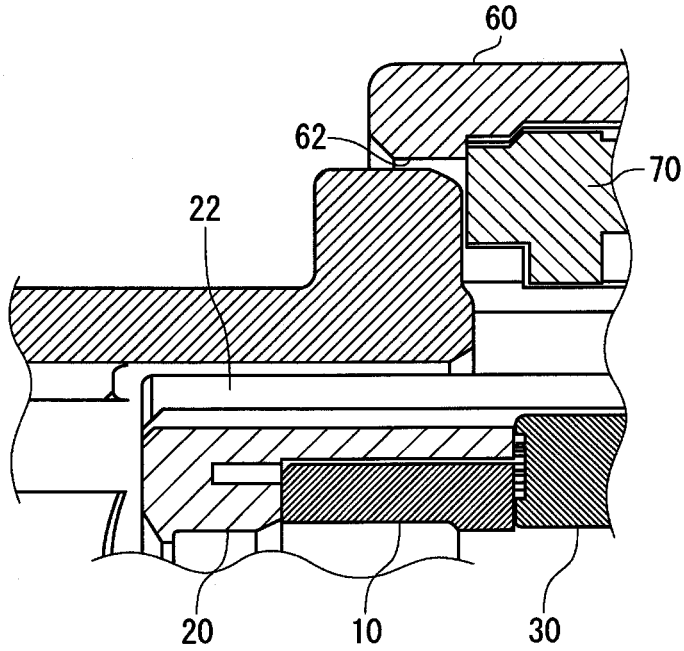
FIG. 6B is enlarged view of a front cover of the lever type connector in FIG. 4.

With reference to FIGS. 3-5, the ribs 22 formed on the front cover 20 are placed correspondingly to a back surface in the vertical direction of the hood 103 of the cam pins 104 formed on the mating connector 100. In this way, the rib 22 formed on the front cover 20 is placed between the front cover 20 and the mating housing 102 correspondingly to the cam pin 104 on the mating connector 100. As shown in FIG. 6, the rib 22 can restrict displacement of the cam pin 104 when the rib 22 is positioned to face the cam pin 104 (FIG. 6A) and also when the rib 22 is offset from the cam pin 104 (FIG. 6B).

When the lever type connector 1 is mated with the mating connector 100, the lever 90 placed in the mating end position is turned to the mating start position (S in FIG. 2) in the direction of arrow B after being unlocked if locked.

When the lever 90 is in the mating start position, each cam pin insertion hole 62 in the outer housing 60 communicates with each cam groove 71 in each slider 70. The lever 90 placed in the mating start position is prevented from turning toward the mating end position by the locking projection 82 on the wire cover 80.

With the lever 90 being placed in the mating start position, each cam pin 104 on the mating connector 100 is inserted through each cam pin insertion hole 62 in the outer housing 60 into each cam groove 71 in each slider 70 to shallowly mate the lever type connector 1 with the mating connector 100.

Figure 7:
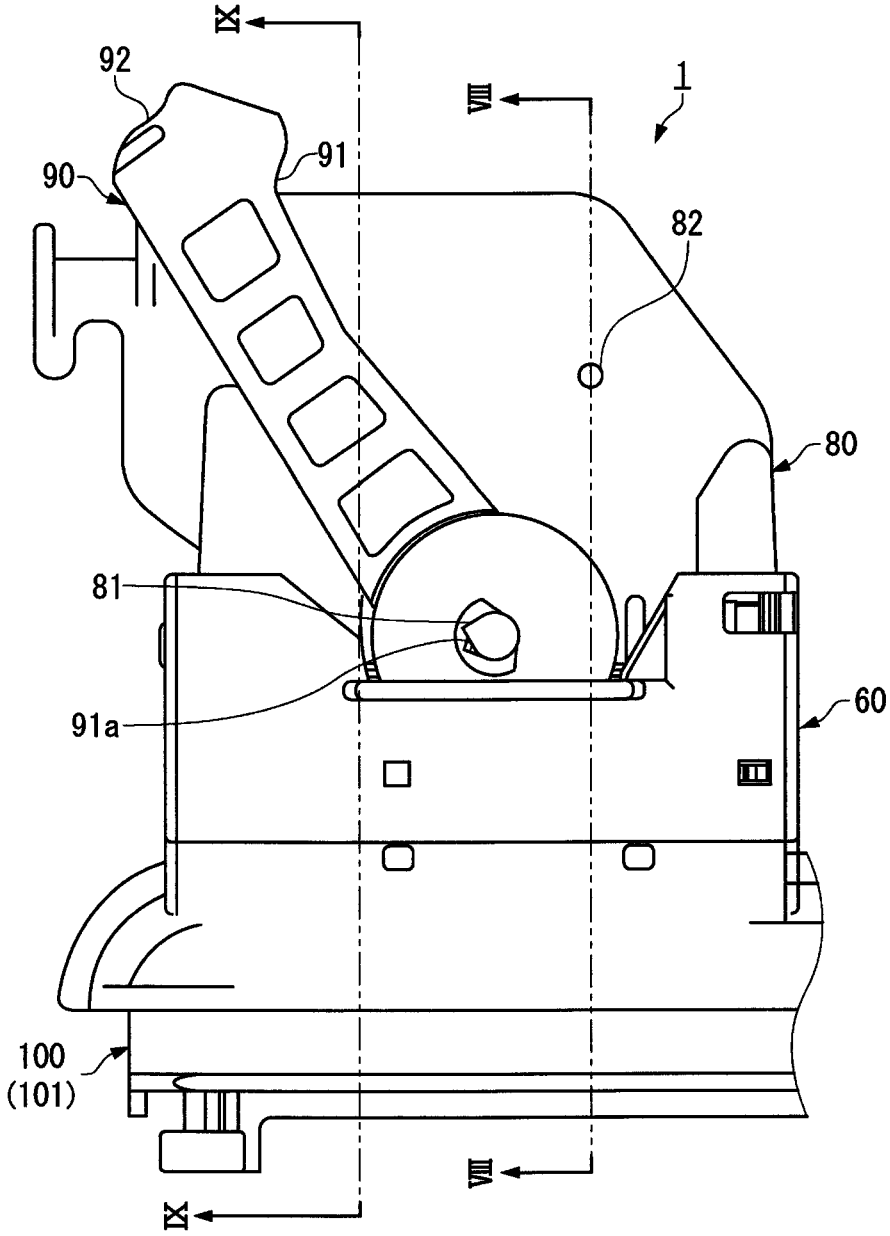
FIG. 7 is a plan view of the lever type connector in FIG. 1 having mated with the mating connector.

Then, the locking of the lever 90 by the locking projection 82 on the wire cover 80 is released, and the lever 90 placed in the mating start position is turned toward the mating end position shown in FIG. 7. Then, each of the plurality of cam grooves 71 in the slider 70 pulls each cam pin 104 on the mating connector 100 toward a back side thereof. Thus, the plurality of contacts (not shown) received in the inner housing 10 of the lever type connector 1 are mated with the contacts (not shown) received in the mating connector 100, and the lever type connector 1 and the mating connector 100 constitute a lever type connector assembly.

Figure 8:
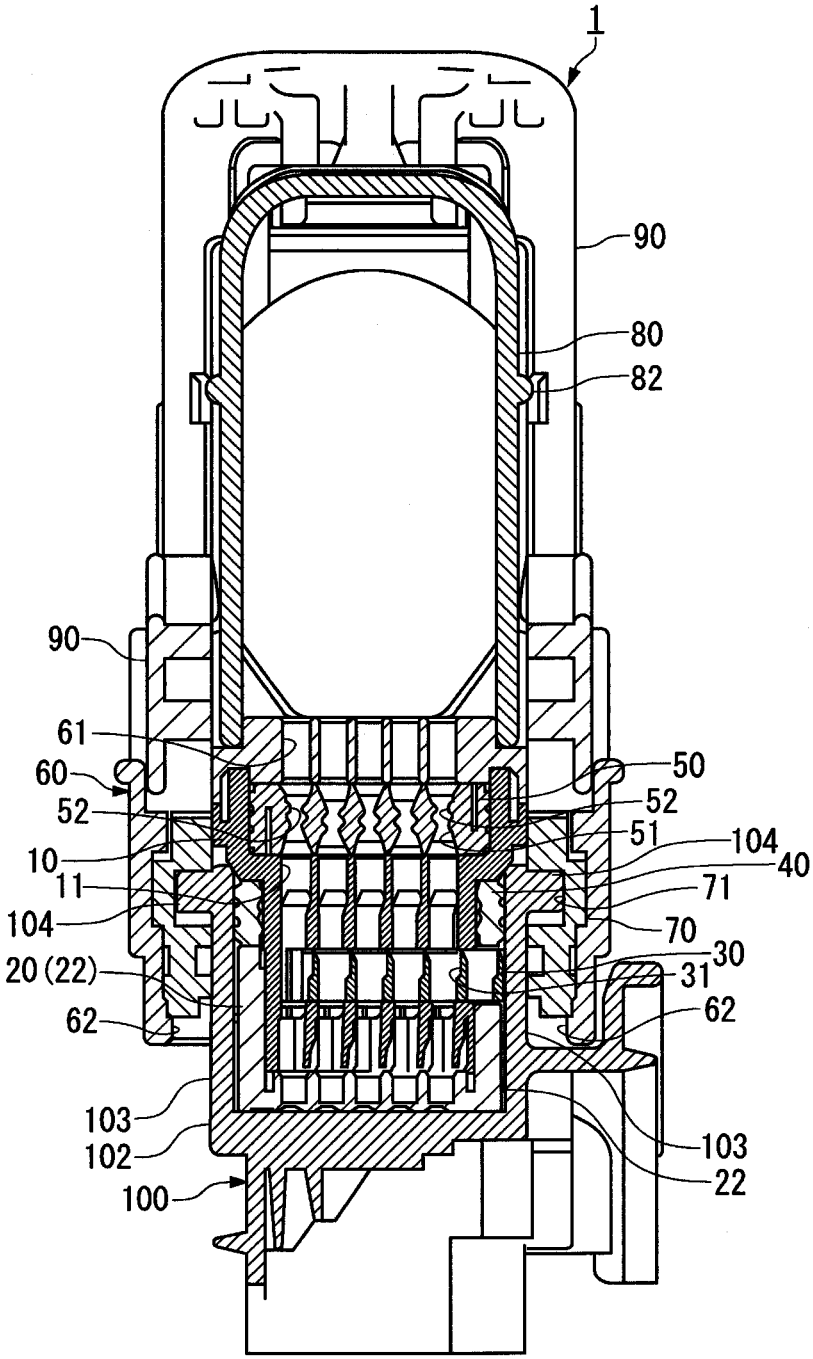
FIG. 8 is a sectional view taken along the arrowed line VIII-VIII in FIG. 7.
Figure 9:
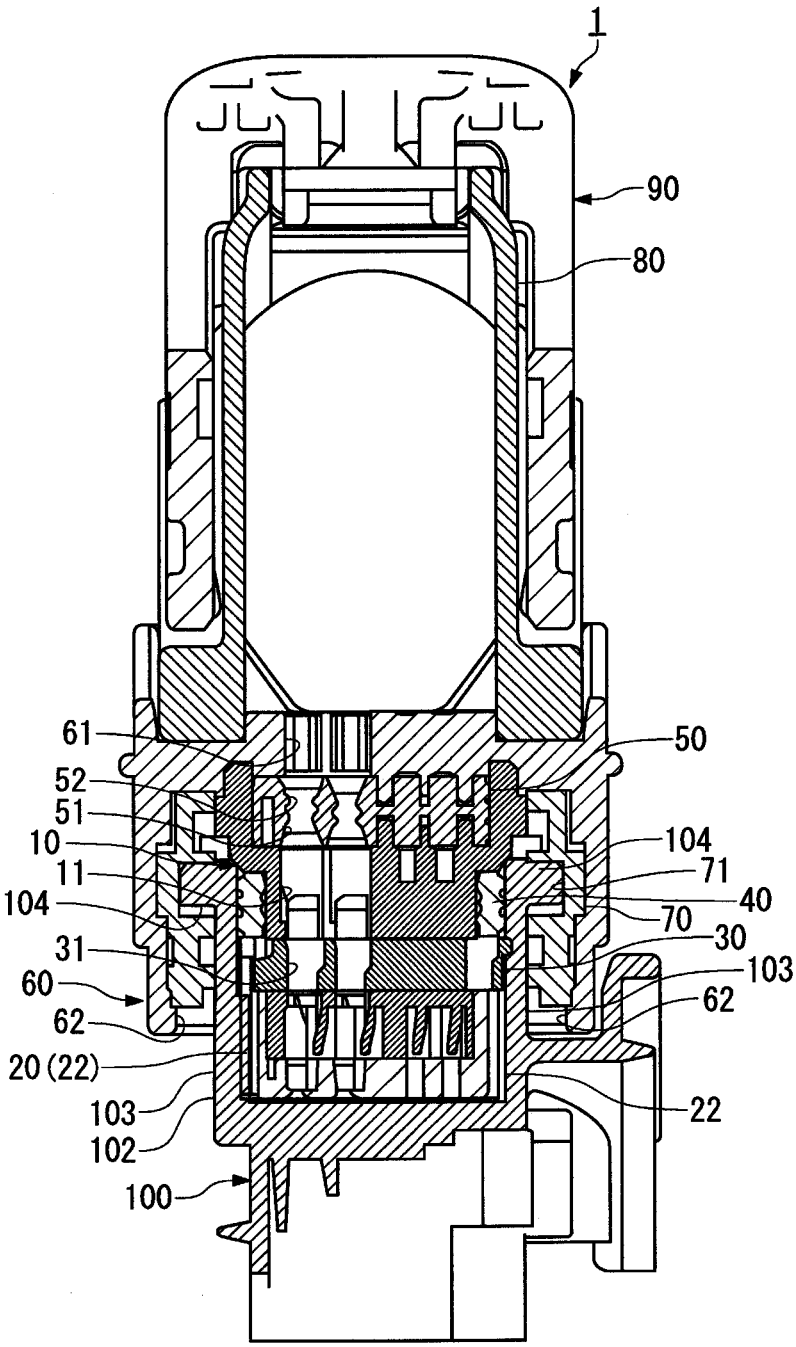
FIG. 9 is a sectional view taken along the arrowed line IX-IX in FIG. 7.

With reference to FIGS. 8 and 9, the front cover 20 passes through the cam pin 104 on the mating connector 100 and is moved all the way into the cavity 101. In the mating end position, the seal 40 is placed between the front cover 20 and the mating housing 102 in the region corresponding to the cam pin 104 on the mating connector 100. There is a possibility of damage to the housing 102 (hood 103) of the mating connector 100 in the initial stage of the mating, and when the mating is completed, there is no need to place the rib 22 in the region corresponding to the cam pin 104.

In the process of the mating operation described above, the cam pin 104 does not properly enter the cam pin insertion hole 62 and the cam groove 71 in some cases. In those cases, the cam pin 104 rides on parts of the outer housing 60 and the slider 70 other than the cam pin insertion hole 62 and the cam groove 71. If the lever 90 is turned toward the mating end position without recognizing the improper mating in the initial stage of mating, the hood 103 on both sides of the mating housing 102 of the mating connector 100 is firmly pressed toward the cavity 101 via the cam pin 104.

However, in the lever type connector 1, the rib 22 is on the outer surface of the front cover 20 in the region corresponding to the cam pin 104 on the mating connector 100, and thus displacement of the hood 103 is restricted to prevent damage to the mating connector 100.

The lever type connector 1 includes the seal 40 for waterproofing, but a space in which the seal 40 is compressed is used for ensuring waterproof performance. Thus, a gap is positioned between the outer surface of the front cover 20 and the hood 103 of the mating connector 100 in order to ensure a compression space for the seal 40. Thus, without the rib 22 in the position, the hood 103 is displaced toward the cavity 101 by an amount corresponding to the gap and may be damaged. On the other hand, in the embodiment shown, the rib 22 is in the region corresponding to the cam pin 104 where a displacement amount toward the cavity 101 becomes maximum when the lever 90 is operated in an improper mating in the initial stage of mating, thereby restricting the displacement of the hood 103.

The present invention includes a design wherein an outer dimension of the front cover 20 is generally increased to generally reduce the gap between the mating connector 100 and the front cover 20. However, for convenience of dimensional accuracy of components formed by injection molding, too small a gap may prevent mating. On the other hand, when the rib 22 is formed as in this embodiment, higher dimensional accuracy can be obtained than when the outer dimension of the front cover 20 is generally increased. Thus, according to the embodiment shown, in which the rib 22 is formed in the region corresponding to the cam pin 104, the gap between the mating connector 100 and the front cover 20 can be reduced.

Increasing a thickness of the hood 103 effectively prevents damage to the hood 103, but this is against a size reduction required of connectors. Also, in response to the number of terminals of the connector together with the size reduction, power generated by operating the lever 90 tends to be increased. Then, if the lever 90 is operated in an improper mating in an initial stage of mating, a large load is applied to the hood 103. Thus, the present invention can prevent damage to the hood 103 without increasing the thickness of the hood 103, and thus can provide a lever type connector that satisfies the demand for the size reduction and numerous terminals.

The embodiment shown has been described on the lever type connector 1 of a waterproof type. However, when a pair of connectors requires a gap provided between connector housings of the connectors, it goes without saying that the present invention may be applied to a lever type connector other than of a waterproof type.

The rib 22 to fill the gap between the lever type connector 1 and the mating connector 100 is positioned in the lever type connector 1, but may be positioned in the mating connector 100. The rib 22 is provided in the lever type connector 1 in this embodiment because there is a need to ensure a space for receiving and compressing the seal 40 in the mating connector 100.

In the present invention, an example has been shown where the rib 22 (cam pin displacement restricting body) passes from the position corresponding to the cam pin 104 in mating completion, and this is because there is the seal 40. Thus, the rib 22 (cam pin displacement restricting body) may be positioned corresponding to the cam pin 104 between the initial stage of mating and the mating completion.

In embodiment shown, the rib 22 is positioned in the lever type connector 1, but any member may be positioned in the present invention, as long as it can fill a gap between a pair of connector housings to restrict displacement of the housing 102 (hood 103) of the mating connector 100.

Further, in the present invention shown, the rib 22 is positioned on the front cover 20, but the present invention widely includes an example in which a cam pin displacement restricting body corresponding to the rib 22 is positioned on a component of a housing placed in the region corresponding to the cam pin 104 on the mating connector 100 at least in the initial stage of mating.

The slider 70 of the present invention is used as a cam mechanism, but it may also be applied to a lever type connector including a cam groove provided in a lever.

The foregoing illustrates a possibility for preparing and practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A lever type connector, comprising:

a front cover that holds a plurality of lever side contacts;

a lever removably supported by the front cover to be rotatable between a mating start position and a mating end position;

a slider having a cam groove and being moveable by rotation of the lever, a mating connector having a mating housing that holds a mating contact electrically connected to each of the plurality of lever side contacts and a cam pin formed on the mating housing and inserted into the cam groove; and a cam pin displacement restricting body positioned between the front cover and the mating housing and facing the cam pin such that the cam pin displacement restricting body aligns with the cam pin along a common vertical axis.

2. The lever type connector according to claim 1, wherein the cam pin displacement restricting body is a rib.

3. The lever type connector according to claim 2, wherein the rib is formed integrally with an outer surface of the front cover facing the mating housing.

4. The lever type connector according to claim 3, wherein the rib is formed to protrude beyond other parts of the outer surface of the front cover.

5. The lever type connector according to claim 2, wherein the rib is formed to protrude beyond other parts positioned on an outer surface of the front cover.

6. The lever type connector according to claim 1, further comprising a rack formed at one end edge of the slider that meshes with a pinion in the lever.

7. The lever type connector according to claim 1, further comprising an outer housing positioned to cover the front cover.

8. The lever type connector according to claim 7, wherein the outer housing includes a slider receiving slot formed in an upper or a lower end of the outer housing and extending in a width direction.

9. The lever type connector according to claim 8, wherein the slider is slidably received in the slider receiving slot in the outer housing.

10. The lever type connector according to claim 9, further comprising a cam pin insertion hole positioned in an inside of the outer housing.

11. The lever type connector according to claim 9, wherein the cam pin is inserted into the cam pin insertion hole.

12. The lever type connector according to claim 2, wherein the rib extending from the front housing and rigidly supporting a back surface of the mating housing opposite a front surface the cam pin there from.

13. The lever type connector according to claim 12, wherein the rib restricts displacement of the cam pin by preventing the mating housing from movement toward the front cover.

14. The lever type connector according to claim 3, wherein the rib extends from one outer edge of the front cover to another outer edge of the front cover.

15. A lever type connector, comprising:

a front cover that holds a plurality of lever side contacts;

a lever removably supported by the front cover to be rotatable between a mating start position and a mating end position;

a slider having a cam groove and being moveable by rotation of the lever;

a mating connector having a mating housing that holds a mating contact electrically connected to each of the plurality of lever side contacts and a cam pin formed on the mating housing and inserted into the cam groove; and a cam pin displacement restricting body rigidly positioned between the front cover and the mating housing and facing the cam pin.

16. The lever type connector according to claim 15, wherein the cam pin displacement restricting body is integrally formed with the front cover along an outer surface thereof and facing the mating housing.

17. The lever type connector according to claim 16, wherein the cam pin displacement restricting body extends outward from the outer surface.

18. The lever type connector according to claim 17, wherein the cam pin displacement restricting body extends along a length of the outer surface between opposite outer edges thereof

19. A lever type connector, comprising:

a front cover that holds a plurality of lever side contacts;

a lever removably supported by the front cover to be rotatable between a mating start position and a mating end position;

a slider having a cam groove and being moveable by rotation of the lever;

a mating connector having a mating housing that holds a mating contact electrically connected to each of the plurality of lever side contacts and a cam pin formed on the mating housing and inserted into the cam groove; and a cam pin displacement restricting body positioned between the front cover and supporting the mating housing such that the cam pin displacement restricting body aligns with the cam pin.

20. The lever type connector according to claim 19, wherein the cam pin displacement restricting body is integrally formed with the front cover along an outer surface thereof and facing the mating housing.

21. The lever type connector according to claim 16, wherein the cam pin displacement restricting body extends outward from the outer surface.

22. The lever type connector according to claim 17, wherein the cam pin displacement restricting body extends along a length of the outer surface between opposite outer edges thereof.

5

* * * * *